US009341439B2

(12) United States Patent
Michal et al.

(10) Patent No.: US 9,341,439 B2
(45) Date of Patent: May 17, 2016

(54) FIREARM FORE END COVERS AND GRIPS

(71) Applicants: Frank Michal, Medina, OH (US); Michael E. Stein, New Philadelphia, OH (US)

(72) Inventors: Frank Michal, Medina, OH (US); Michael E. Stein, New Philadelphia, OH (US)

( * ) Notice: Subject to any disclaimer, the term of this patent is extended or adjusted under 35 U.S.C. 154(b) by 0 days.

(21) Appl. No.: 14/609,009

(22) Filed: Jan. 29, 2015

(65) Prior Publication Data

US 2015/0345896 A1 Dec. 3, 2015

Related U.S. Application Data

(60) Provisional application No. 61/932,896, filed on Jan. 29, 2014.

(51) Int. Cl.
*F41C 23/16* (2006.01)

(52) U.S. Cl.
CPC ..... *F41C 23/16* (2013.01)

(58) Field of Classification Search
CPC ..... F41A 21/44; F41C 23/16–23/18
USPC ..... 42/75.01
See application file for complete search history.

(56) References Cited

U.S. PATENT DOCUMENTS 1,451,137 A * 4/1923 Baily ..... F41C 23/16 42/106
2,104,129 A * 1/1938 Kress ..... F41C 23/16 42/71.01
2,282,428 A * 5/1942 Rigandi ..... F41A 35/02 42/74
3,367,054 A * 2/1968 Loffler ..... B29D 23/001 42/71.01
4,947,573 A * 8/1990 Bischoff ..... F41C 23/00 2/161.5
5,016,148 A * 5/1991 Kohm ..... F21L 7/00 16/426
5,121,564 A * 6/1992 Story ..... F41C 27/00 224/239
5,265,365 A * 11/1993 Finn ..... F41C 23/00 224/239
5,678,345 A * 10/1997 Gnade ..... F41C 27/22 42/97
5,771,622 A * 6/1998 Koziuk ..... F41C 27/00 42/74
6,397,507 B1 * 6/2002 Marshall ..... F41C 23/16 42/106
6,988,755 B2 * 1/2006 Lukas ..... F41A 35/00 224/913
7,103,940 B2 * 9/2006 Ogg ..... B65D 23/106 16/422
D615,142 S * 5/2010 Bentley ..... D22/108
7,861,380 B2 * 1/2011 Moore ..... A61H 3/00 16/421
7,937,875 B1 * 5/2011 Berg ..... F41C 23/16 42/71.01
8,109,027 B2 * 2/2012 Cragg ..... F41A 11/02 42/73
8,931,197 B2 * 1/2015 Larson ..... F41C 23/16 42/71.01
9,140,511 B2 * 9/2015 Michal ..... F41A 21/30
2010/0269392 A1 * 10/2010 Swan ..... F41C 23/18 42/71.01
2011/0016764 A1 * 1/2011 Cales ..... F41C 23/14 42/90
2015/0096215 A1 * 4/2015 Somogy ..... F41C 23/16 42/71.01

* cited by examiner

*Primary Examiner* — Troy Chambers
*Assistant Examiner* — Joshua Semick
(74) *Attorney, Agent, or Firm* — Black, McCuskey, Souers & Arbaugh, LPA

(57) ABSTRACT

Firearm fore end grips and grip assemblies have a generally planar and flexible heat resistant grip which is configured for attachment or securement to a fore end of a fire arm or to a barrel cover and engaged with a Picatinny rail of the firearm or barrel cover.

22 Claims, 19 Drawing Sheets

FIREARM FORE END COVERS AND GRIPS

RELATED APPLICATIONS

This application is related to U.S. provisional application No. 61/932,896, filed Jan. 29, 2014.

FIELD OF THE DISCLOSURE

The present disclosure and related inventions is in the general field of firearms and firearm accessories.

BACKGROUND OF THE DISCLOSURE

Firearm barrels absorb a large amount of heat from firing action particularly under rapid firing rates of semi-automatic and fully automatic weapons. Barrel heat along the entire length reaches temperatures at which skin or other materials are quickly burned on contact. High heat accumulation occurs even with barrel ventilation openings. Fore end barrel structures which extend forward of the breech and about the barrel also absorb heat from the barrel and may reach temperatures excessive for bare hand contact. Also, prior art fore end grips are constructed of steel, aluminum or hard plastic and do not provide an optimal gripping surface for secure handling and firing of a weapon.

SUMMARY OF THE DISCLOSURE

The present disclosure and related inventions provides novel covers and grips adapted for use with a wide variety of firearms and specifically configured for engagement with a fore end or barrel of a firearm, including such firearm weapons as carbines and machine guns and any long guns including rifles and shotguns. As illustrated, the various representative embodiments of firearm fore end covers and grips the present disclosure (also referred to herein collectively and generally as "fore end grip" or "grip"), indicated generally at 100, are in the form of a generally planar piece of flexible material which is configurable to be wrapped or otherwise arranged about a fore end of a weapon W, at a fore end location generally forward of the breech and configured to fit closely against the exterior surface of a gun barrel, such as for example a cylindrical form gun barrel or barrel cover or guard, and configured to fit on the fore end or barrel or barrel grip of any gun having an extended length. As illustrated, an exemplary embodiment of a fore end grip indicated generally at 100 is in the form of a flexible planar member which has a contoured exterior gripping surface that may include for example a series of ribs 101 or ridges or other protrusions or patterned protrusions. In preferred embodiments, some or all of the protrusions or ribs run generally transverse to the fore end and barrel of the gun when installed. The length of the fore end grip 100 can be specific to the fore end dimensions of any weapon or weapon platform, or custom cut or molded. When made of material (as further described herein) which can be cut, the fore end grip 100 can be cut along either the front or rear sides or edges, indicated F and R, in a straight line or any other configuration for any particular installation.

A preferred configuration for fitment and attachment of the fore end grip 100 to the fore end of a gun is in connection with a gun rail system such as the Picatinny rail system. In the illustrated embodiment, a Picatinny rail, indicated at PR, is located at the top of the fore end and barrel of a gun running generally from the breech to or toward the muzzle. The Picatinny rail PR may be formed integral with a gun barrel or integral with a barrel cover BC as illustrated. As known, other gun rail configurations may include Picatinny rails located laterally of the top of the gun barrel, i.e. ninety degrees relative to the top rail, and/or along the bottom of the gun barrel, or similarly located as part of a barrel cover. The fore end grip 100 may attach to any rail in any of these locations, and/or may extend over one or more rails.

DETAILED DESCRIPTION

Figure 1:
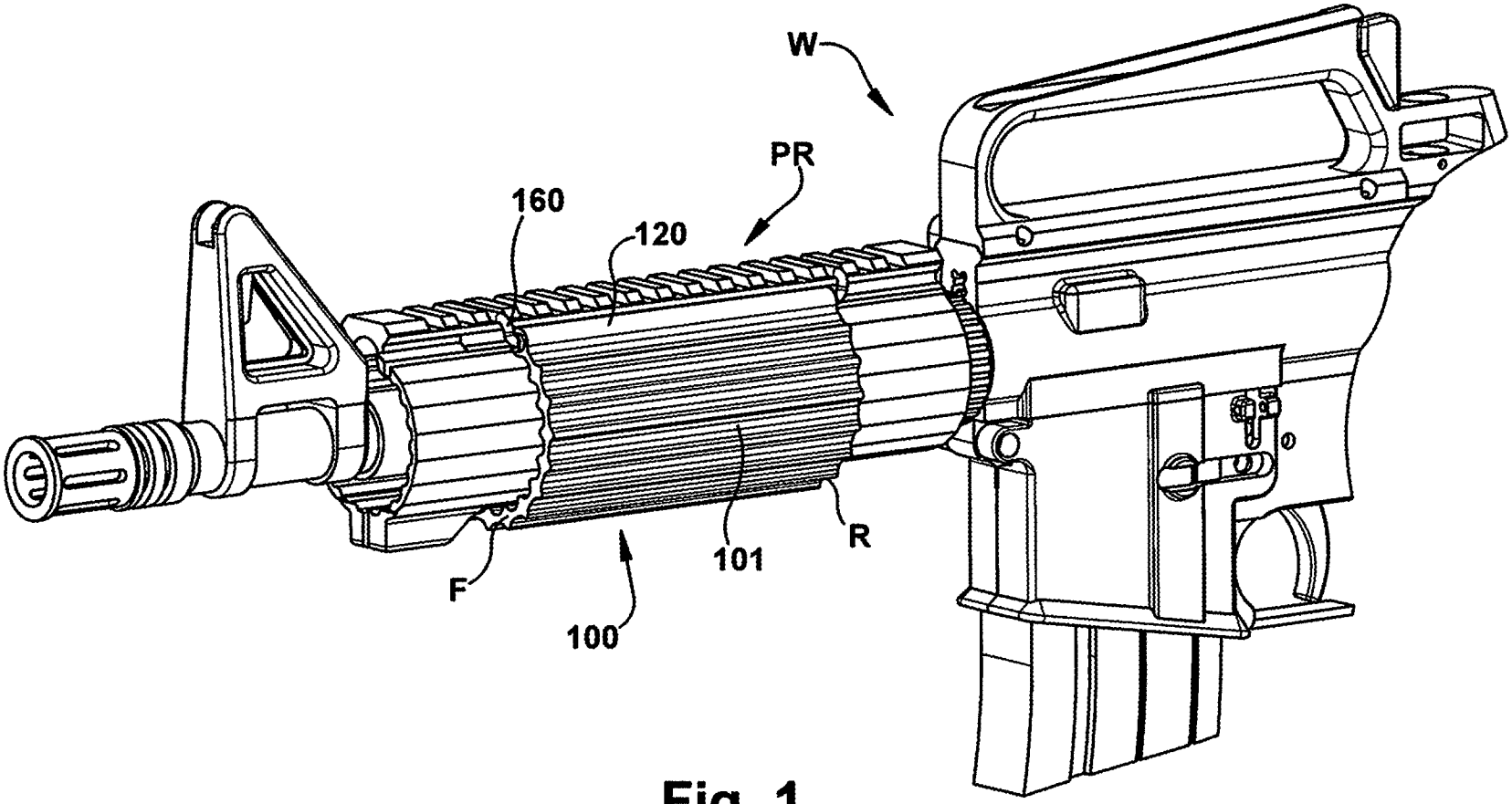
FIG. 1 is a perspective view of a fore end grip of the present disclosure.

As illustrated in FIGS. 1-8, the generally rectangular outline of the fore end grip 100 is defined by the front and rear ends, F, R, and first and second edges 110, 120. Each side edge 110, 120 is formed with an attachment structure, opening or fitment, generally indicated at 111 and 121 respectively. In the illustrated embodiment, the attachment structures 111, 121 are in the form of cylindrical cavities with openings to the front and rear ends F, R, each dimensioned and configured to receive a fastener 160, which may be in the form of a rod or wire form with terminal segments or ends 162 which extend into the openings to structures 111, 121 and extending over the Picatinny rail as illustrated, and even more preferably having a medial segment 161 which fits between two of the upstanding flanges of the Picatinny rail, as illustrated. In an alternate embodiment, the fore end grip 100 may be configured with multiple attachment structures 111*a*, 111*b*, 111*c*, 121*a*, 121*b*, 121*c* in parallel arrangements as illustrated to provide variable total widths to the fore end grip 100 as measured between the opposing edges 110, 120. By this arrangement the circumferential extent of the fore end grip can be varied and selected for optimal tight fit against the fore end of any particular weapon by selection of the appropriate structure 111, 121 and installation of the fastener 160 therein. With a fastener 160 located at the front and rear ends F, R of the grip and the fastener segments 162 spanning between the opposing edges 110, 120 and across the Picatinny rail, the grip 100 is thus secured to the fore end of the gun. Preferably, a width dimension of the grip as measured from edge 110 to edge 120 is equal to or less than the partial circumference of the fore end of the gun over which the grip is disposed so that the grip is drawn tightly against the fore end by fasteners 160.

Figure 2:
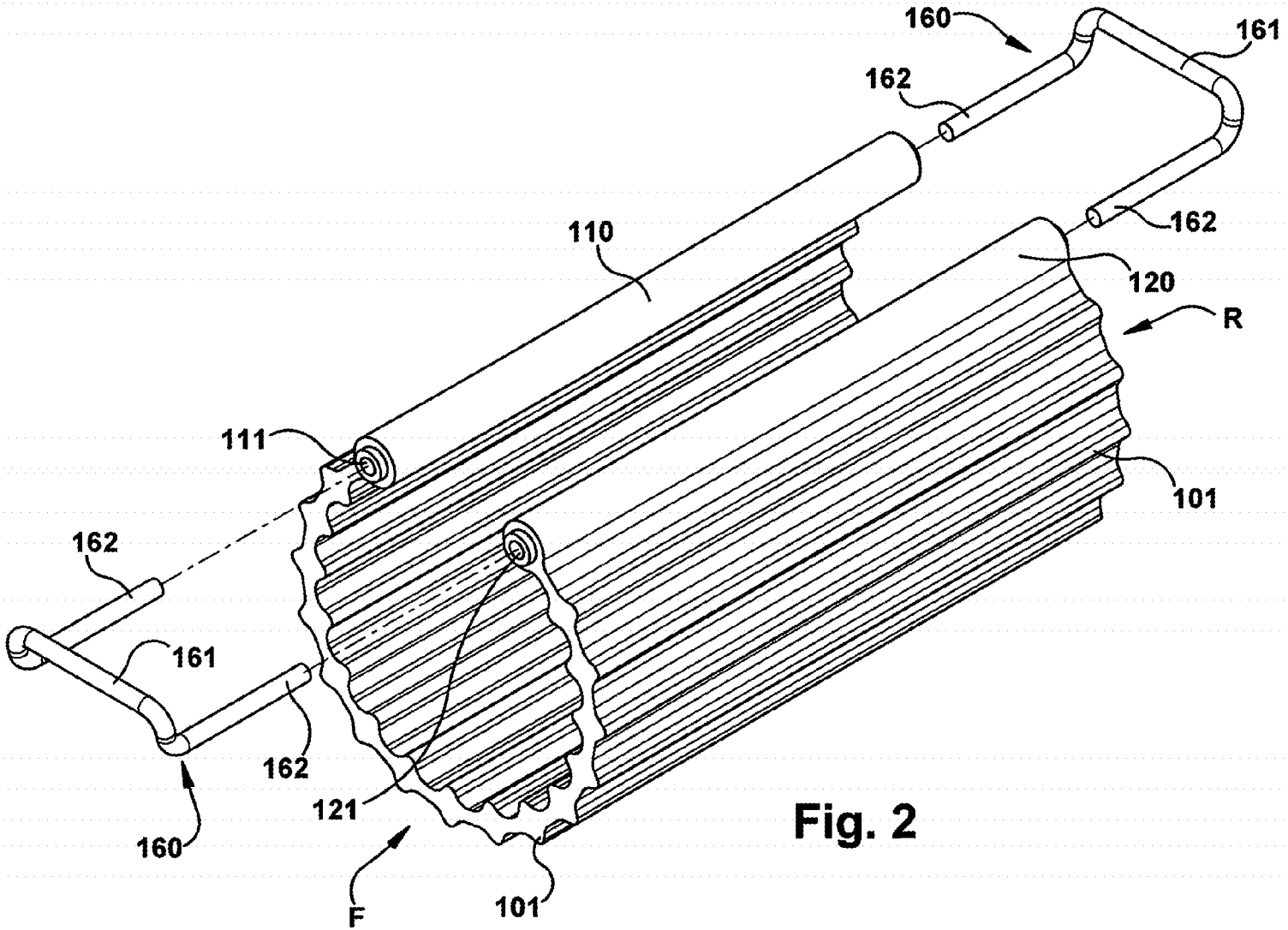
FIG. 2 is a perspective view of a fore end grip of the present disclosure.
Figure 3:
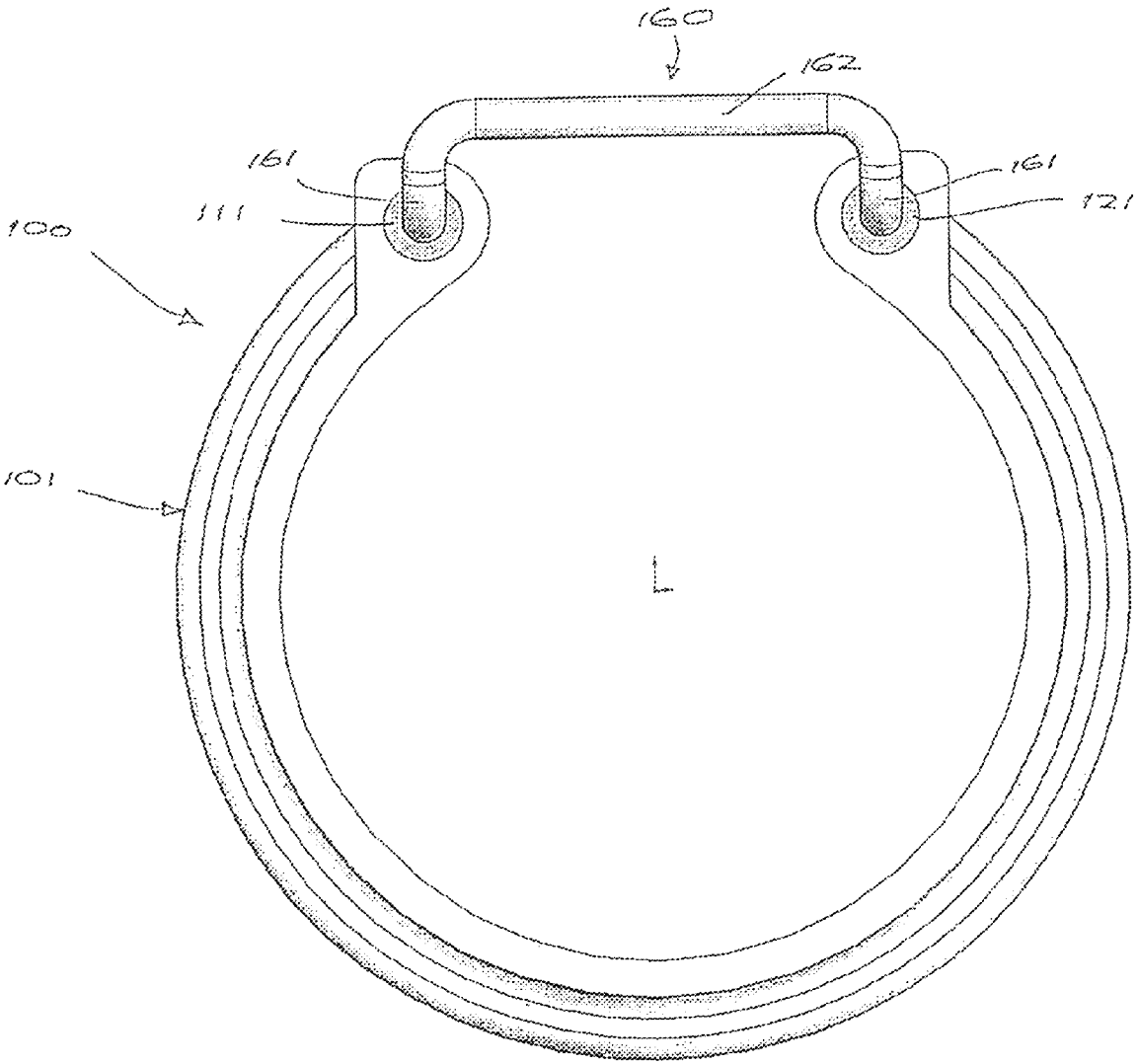
FIG. 3 is an end view of a fore end grip of the present disclosure.
Figure 4:
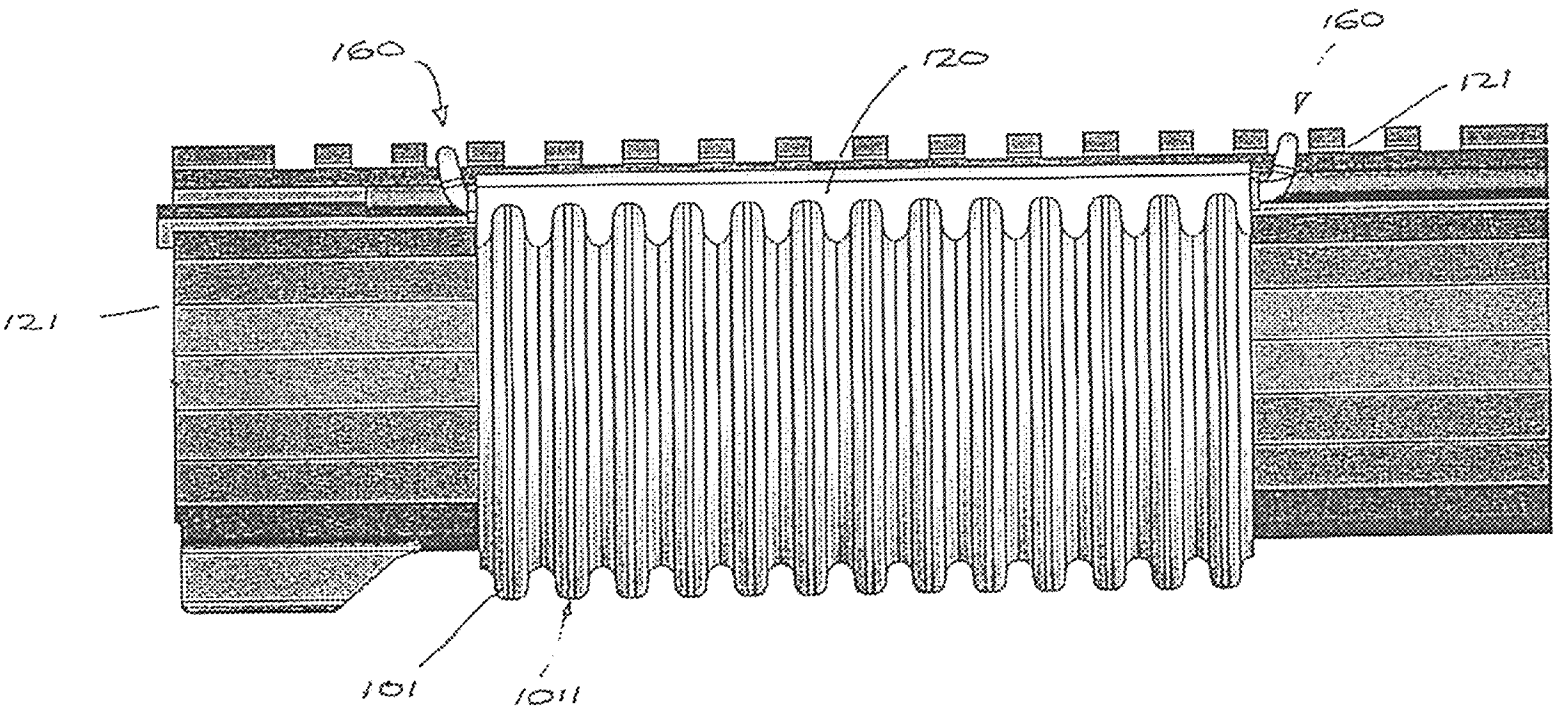
FIG. 4 is a side view of a fore end grip of the present disclosure.
Figure 5:
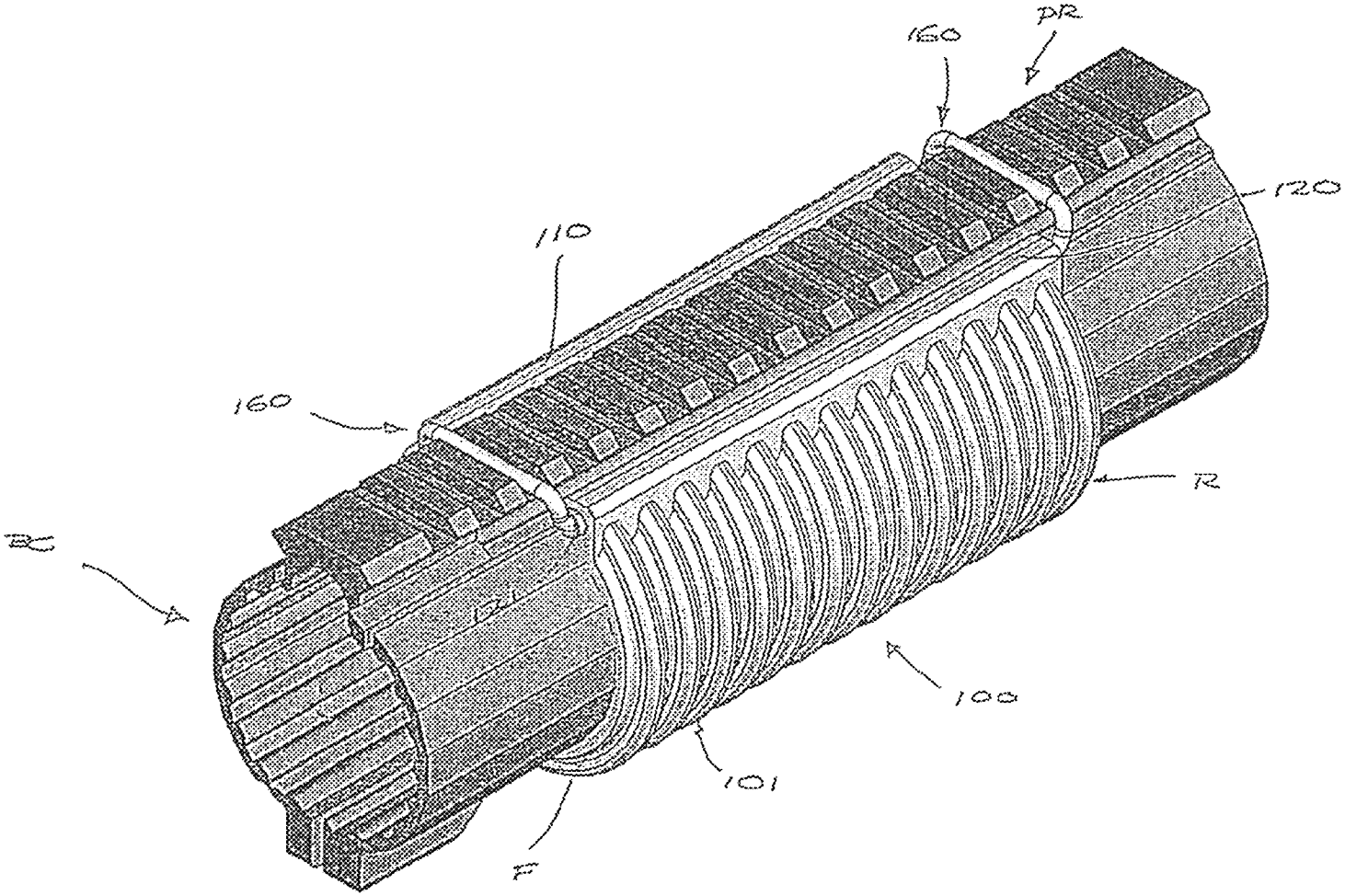
FIG. 5 is a perspective view of a fore end grip of the present disclosure.
Figure 6:
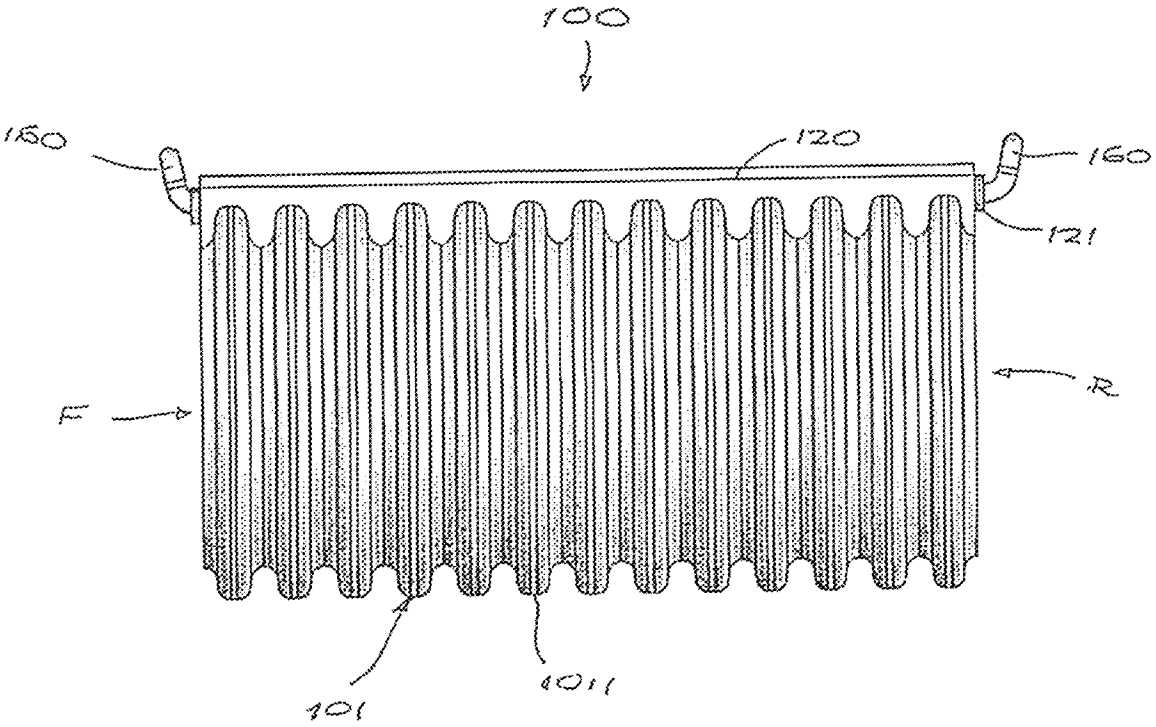
FIG. 6 is a side view of a fore end grip of the present disclosure.
Figure 7:
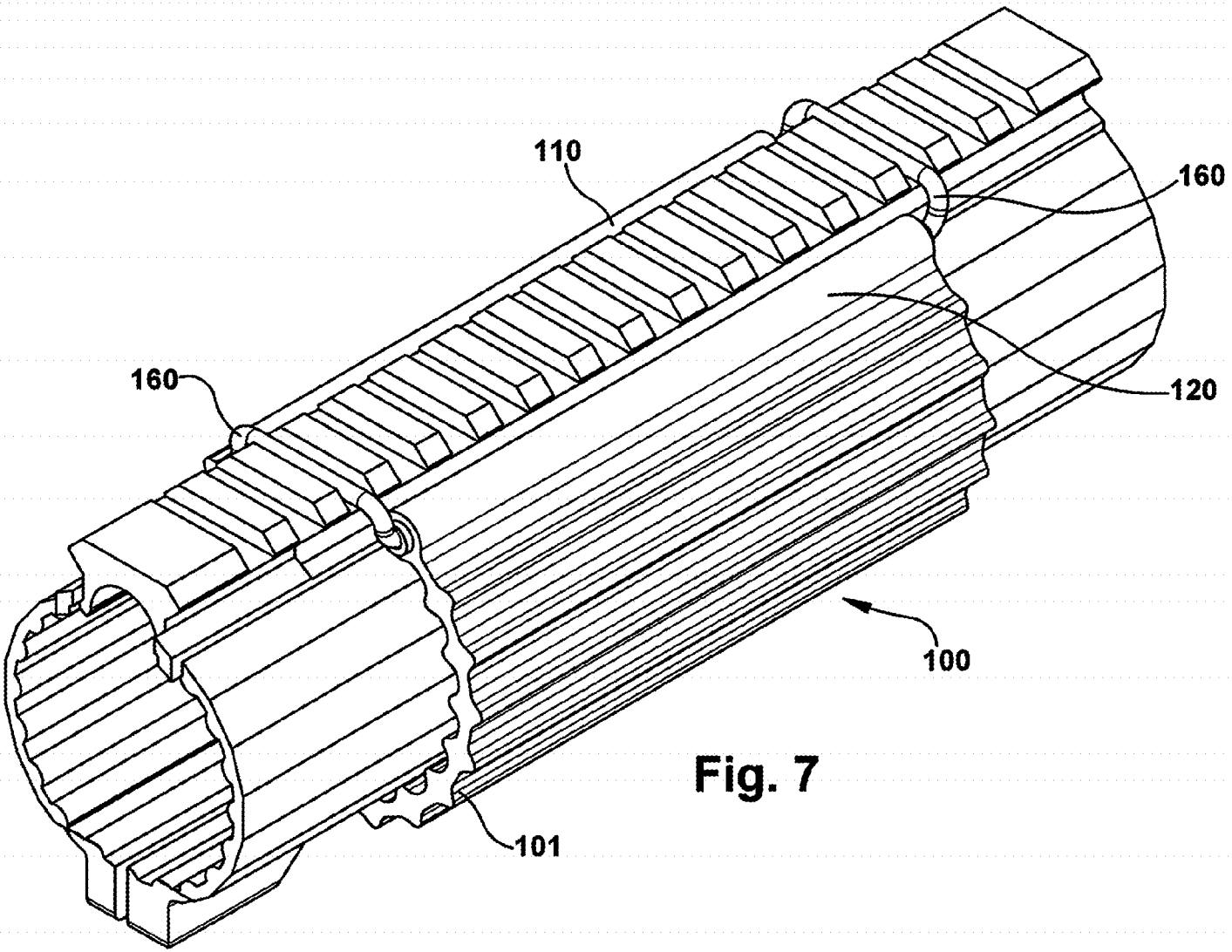
FIG. 7 is a perspective view of a fore end grip of the present disclosure.
Figure 8:
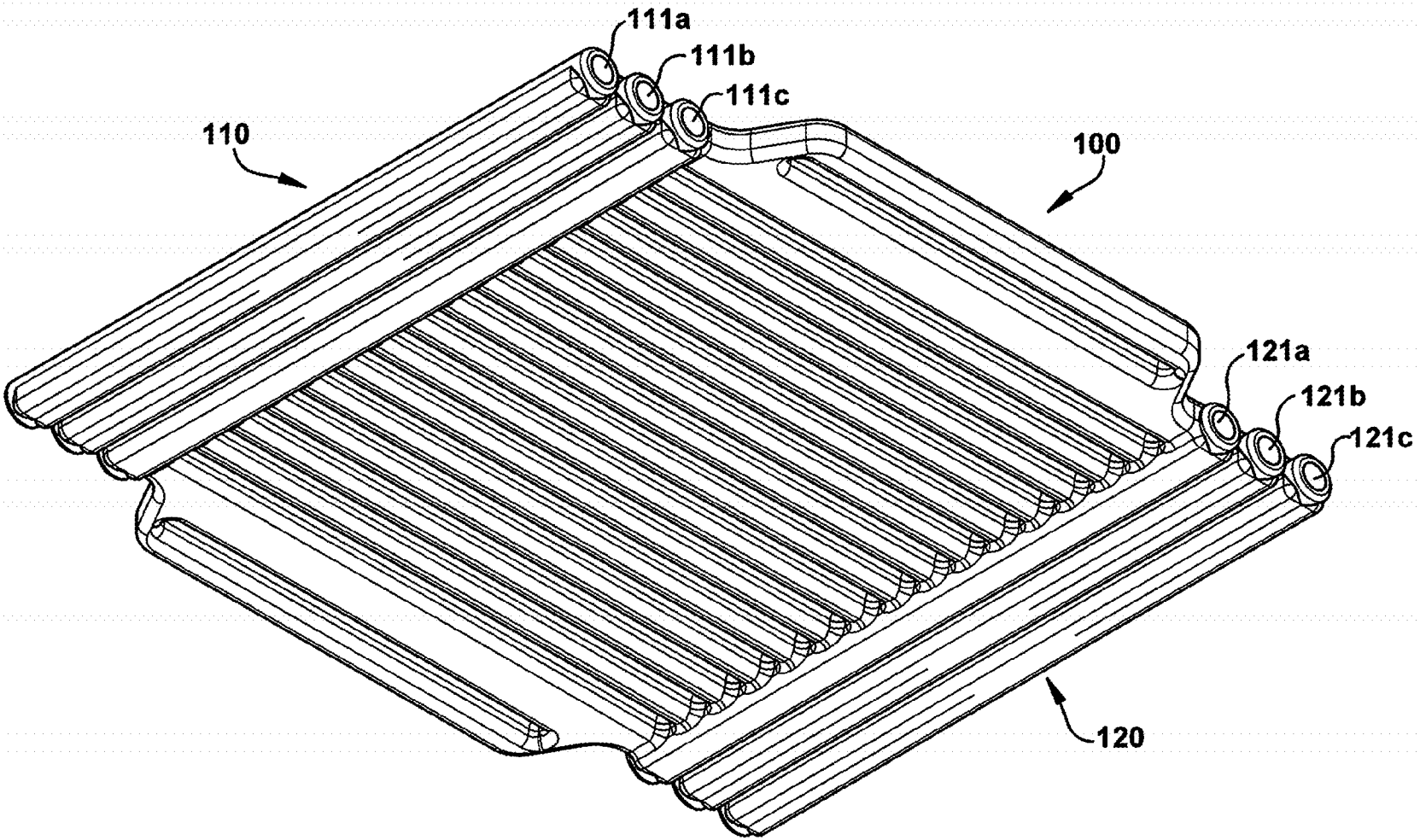
FIG. 8 is a perspective view of a fore end grip of the present disclosure in an un-installed configuration.

As shown in FIG. 2, the underside of the grip may be formed to be generally planar, or alternatively with internal ribs dimensioned and formed to contact the exterior surface of a firearm barrel throughout the length of the grip 100. An exterior surface of the grip 100 is preferably formed or configured with a plurality of ribs 101 disposed radially about the generally cylindrical form of the barrel grip 100, and/or perpendicular to the interior ridges 110 in the internal bore 101. The ribs 101 project radially outward from the generally cylindrical body 105 of the grip 100, as shown, and provide a gripping surface on substantially the entire exterior of the barrel grip 100. Additional or alternate exterior features which can be incorporated into the fore end grip 100 are ends 122 and 124 which also project radially from the cylindrical body and can project an extent greater than the ribs 101, and each provide tactile locators for hand placement on the grip 100. Alternatively, the ribs 101 may be in other geometric forms than the generally linear configurations illustrated, or any other configurations of contours, profiles or projections formed to extend from the exterior surface of the fore end grip 100 to provide a gripping surface.

Figure 9A:
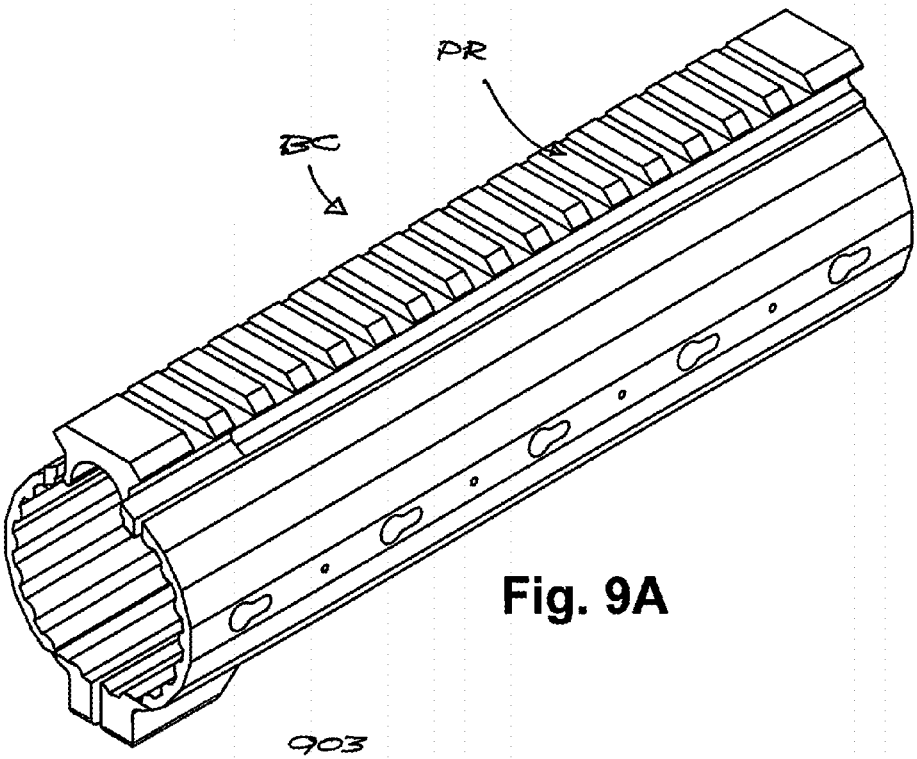
FIGS. 9A through 9E are perspective and end views of alternate embodiments of a fore end grip of the present disclosure.
Figure 9B:
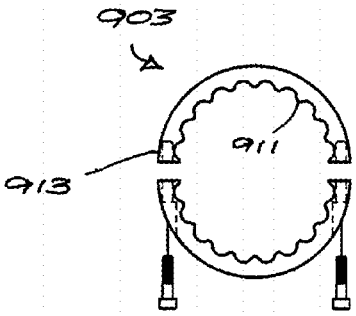
Figure 9C:
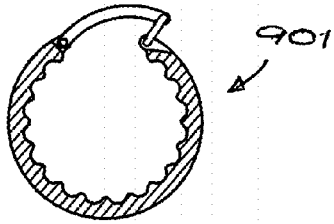
Figure 9D:
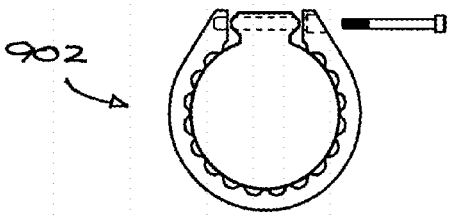
Figure 9E:
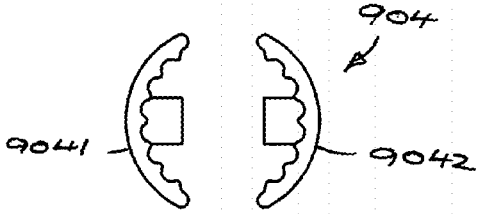

As further illustrated, alternate embodiments of the fore end grips 100 of the disclosure which are generally configured for attachment to a barrel cover BC as illustrated in FIG. 9A, such as for example barrel covers of the type used in connection with AR-15 rifles and M16 rifles and other military style rifles and hunting rifles and shotguns with extended length barrels and covers, can be formed or molded in different configurations of internal and external surface configurations or contours, and with different types of attachment means for securing the fore end grip to a barrel or barrel cover. As illustrated the barrel cover BC may have an integrally formed Picatinny rail, indicated PR. As shown in FIGS. 9C and 9D, the disclosure includes a one-piece slip-on type fore end grip or cover, indicated at 901 in FIG. 9C and 902 in FIG. 9D in generally cylindrical form which is sufficiently pliable to be slipped over the exterior of a barrel cover. The fore end grip may have a smooth or contoured or textured exterior, and as illustrated one or more ribs 911 on the interior surface which may engage with correspondingly located grooves in a barrel cover. Any exterior surface contouring may be formed. FIGS. 9B and 9E illustrate an alternate embodiment of fore end grips 903 and 904 which have two opposing halves which are linearly aligned when the grip is in position about a barrel cover, and with a single aligned fastening hole 913 to receive a rod or pin or screw to secure the halves of the fore end grip together. FIG. 9C illustrates a fore end grip 901 of the disclosure wherein opposing ends or edges are secured together about a barrel cover by a mechanical lock such as a flip lock 916 which extends from one edge to an opposing edge to secure the fore end grip onto a barrel or barrel cover. Any suitable type of mechanical attachment of the opposing edges or sides of the fore end grip can be used to secure the fore end grip to a barrel or barrel cover. For example FIG. 9E illustrates an alternate embodiment of a fore end grip 904 in which the mating halves of the grip 9041 and 9042 are secured to a fore end cover by a fastener such as a plastic with a one-way tooth or key-mod locking function which may be integrally formed with the planar structure of the grip to tightly hold the grip about the fore end grip and against the barrel or barrel cover. Such fasteners may be separate from the fore end grip or formed integral therewith.

Figure 16:
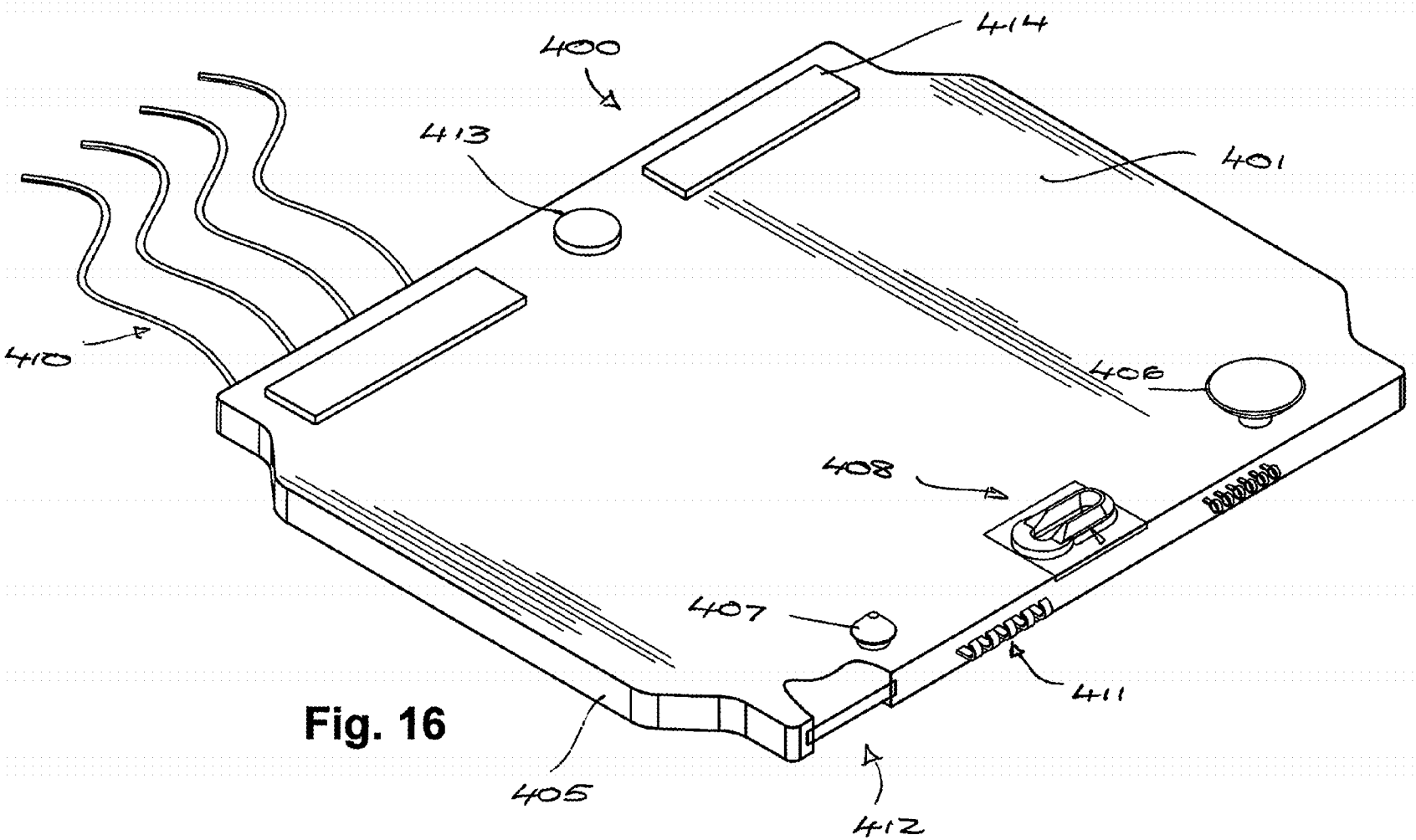
FIG. 16 is a perspective view of an alternate embodiment of a fore end grip of the present disclosure in an un-installed configuration.

FIG. 9E and FIG. 16 illustrate alternate embodiments of a fore end grip of the present disclosure wherein a fastening structure is formed integrally with the grip assembly, such as mating grip halves or pieces. The fastening structure may include one or more internal bosses which fit with a barrel or barrel cover and can be bored or threaded to receive a fastener to secure the grip half to a barrel or barrel cover. Other fastening means such as key mod or slide fit can also be used. The fastening structure may include steel or polymer/plastic structures which are molded with the polymeric grip material. FIGS. 9B and 9D illustrate an alternate embodiments in which screw-type fasteners are positioned to extend laterally through adjoining edges of grip halves, for example into internally formed threaded receivers in the female grip half. FIG. 9D illustrates a top oriented bolt-through arrangement wherein the bolt may extend across a barrel cover or across the Picatinny rail and be secured by threaded engagement with the opposing edge of the single-piece type fore end grip.

Figure 10A:
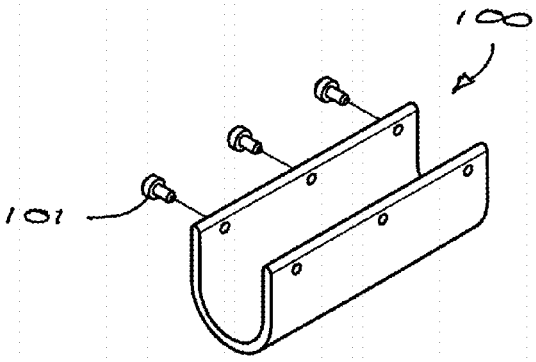
FIG. 10A through 10L are perspective views of alternate embodiments of fore end grips of the present disclosure.
Figure 10B:
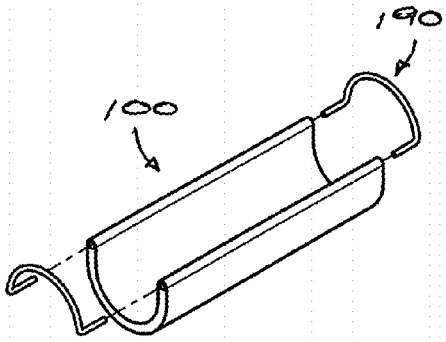
Figure 10C:
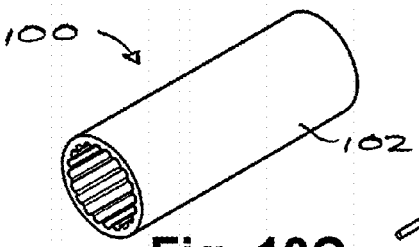
Figure 10D:
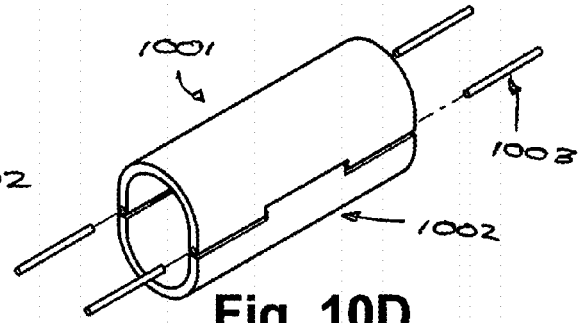
Figure 10E:
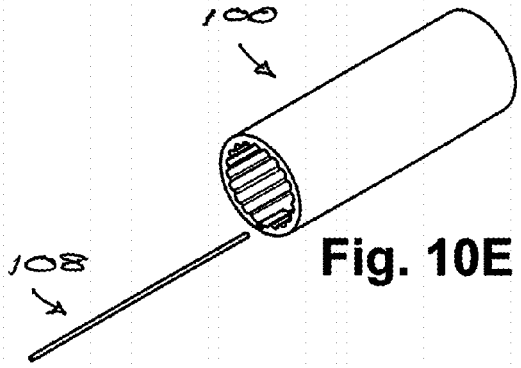
Figure 10F:
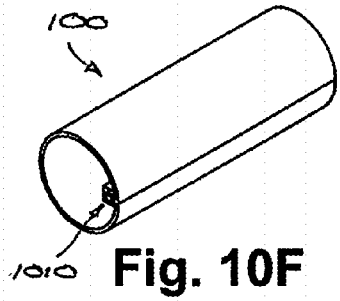
Figure 10G:
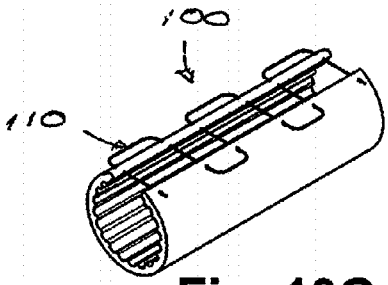
Figure 10H:
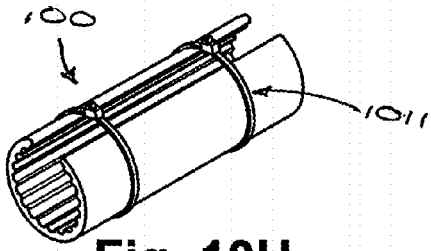
Figure 10I:
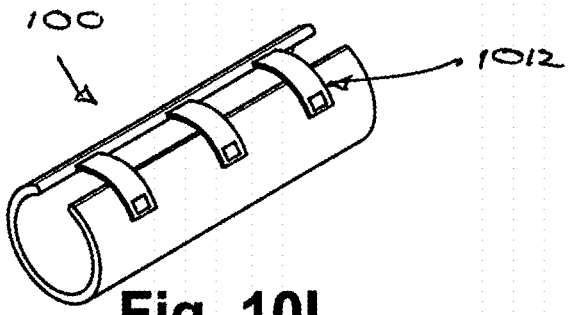
Figure 10J:
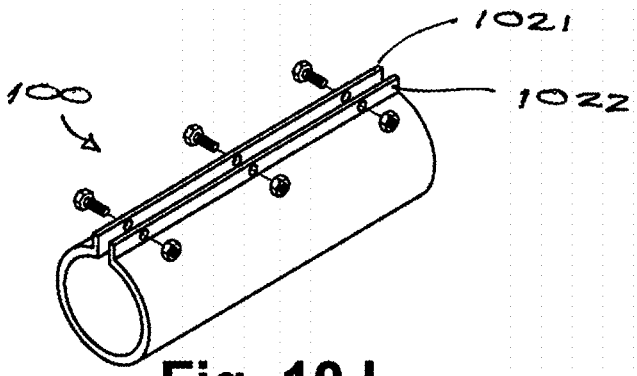
Figure 10K:
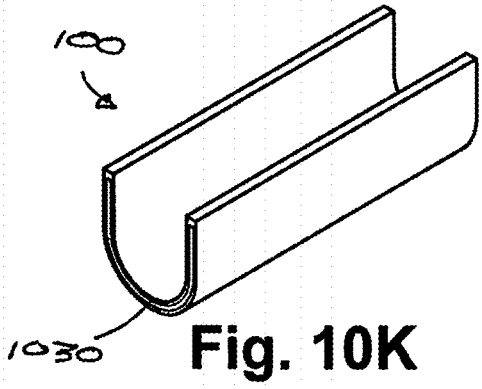
Figure 10L:
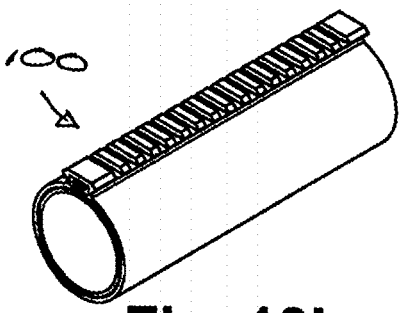

Other alternate embodiments of fore end grips of the present disclosure are suitable for and configured for use with any type of gun which has an extended length barrel, including but not limited to rifles and shotguns, and regardless of the particular configuration of the barrel or barrel grip or cover configuration, including bare or uncovered barrels, or wood or plastic barrel covers or grips or other fore end structures of a gun. For example as shown in FIGS. 10A-10L, fore end grips 100 can be in the form of a generally planar piece that is flexible to be wrapped about the fore end of a gun and opposite edges of the grip secured by fasteners 101 as illustrated for example in FIG. 10A. FIG. 10C illustrates a single-piece cylindrical embodiment of a fore end grip 100 which is installed about a gun fore end by sliding the cylindrical body 102 over a barrel muzzle and on to the fore end of a firearm or over a barrel cover . FIG. 10E illustrates a single piece embodiment of a fore end grip 100 which a single fastener or rod 108 which extends through aligned holes in opposing or mating edges of the grip 100 for attachment about a gun fore end. FIG. 10G illustrates a laced attachment of a fore end grip 100 with laces 110 for securement about a gun fore end, again without limitation as to the type of gun or exterior configuration or surface of the gun fore end. FIGS. 10B and 101 illustrates a fastener-secured embodiment of a single-piece fore end grip 100 utilizing clips 190 which extend between opposing edges of the grip 100 and span a transverse distance or radius of the fore end, such as for example across a Picatinny rail or around a fore end. FIG. 10D illustrates an alternate embodiment of a fore end grip 100 having mating halves or pieces 1001 and 1002 which are connected together by longitudinally oriented fasteners 1002 which extend through overlapping regions of the grip halves. FIG. 10F illustrates a one-piece embodiment of a fore end grip 100 in which the opposing ends of the grip are secured together by an interlocking connection or seam indicated at 1010. FIG. 10H illustrates the use of external fasteners 1011 which clamp or compress or encircle the fore end grip 100 against the exterior of a gun fore end. FIG. 101 illustrates the use of latch type fasteners 1012 which extend from one edge to an opposite edge of the grip 100. FIG. 10J illustrates an alternate embodiment of a grip 100 in which opposing edges or flanges 1021 and 1022 are formed to receive fasteners therethrough which may also extend across a barrel cover or over a Picatinny rail. FIG. 10K illustrates a single-piece embodiment of a fore end grip 100 which has an internal spring component 1030 for spring-biased or self-conforming securement to a gun fore end, and which may partially or completely encompass the circumference of the gun fore end. And FIG. 10L illustrates an integrally formed fore end grip 100 which includes all of the structural features of a barrel cover and Picatinny rail, and the material advantages of the fore end grips 100 as described herein.

Figure 11:
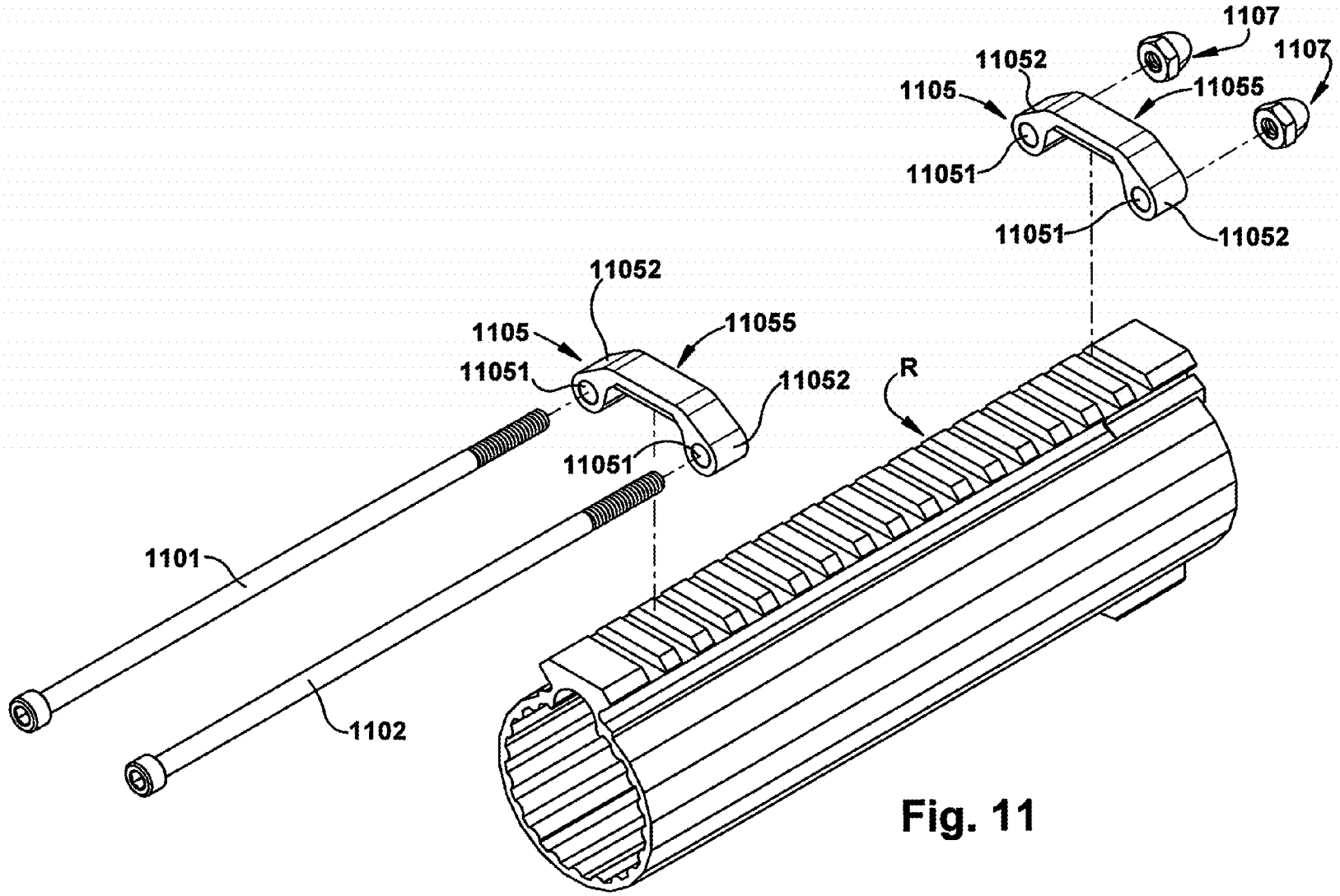
FIG. 11 is a perspective assembly view of the assembled fore end grip of the present disclosure.
Figure 12:
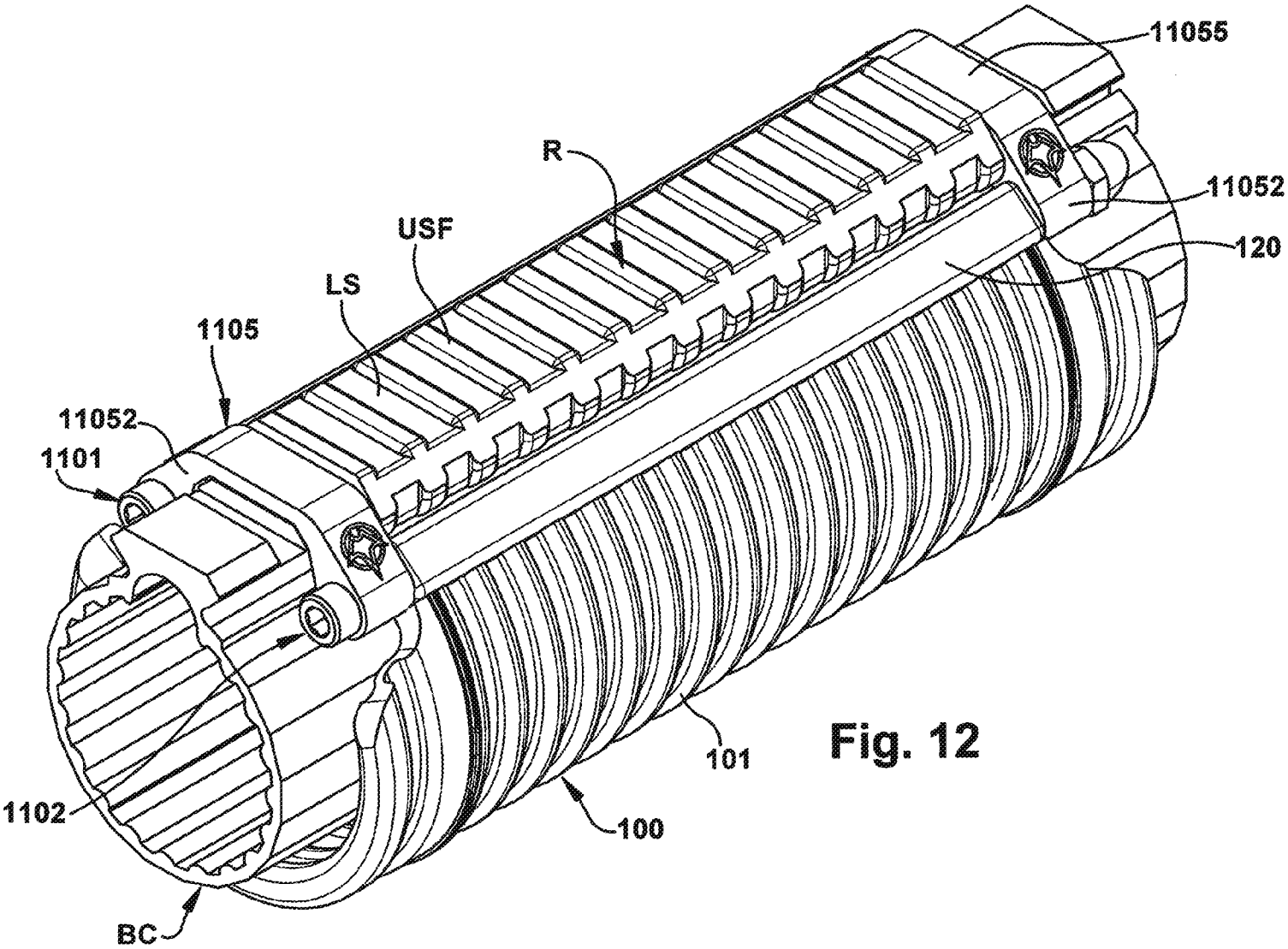
FIG. 12 is a perspective view of the assembled fore end grip of FIG. 11.

FIGS. 11 and 12 illustrate an alternate embodiment of a fore end grip assembly of the present disclosure wherein rods or pins 1101, 1102 are configured to extend substantially the entire length of the fore end grip (not shown in FIG. 11), and more particularly through the attachment structures 111, 112 which extend longitudinally through the edges 110, 120 as previously described. Rod guides 1105 are provided proximate to the front F and rear R ends of the fore end grip 100 and preferably closely proximate to the openings to attachment structures 111, 112, as shown in FIG. 12. The rods 1101, 1102 are passed through openings 11051 in the rod guides 1105 and secured in place by fasteners 1107 such as threaded fasteners. Each rod guide has a pair of bosses 11052 in which an opening 11051 is formed, and a bridge 11055 which spans between the bosses 11052. The bridge can be of any particular configuration and preferably of any configuration and length to span the width of the Picatinny rail R from one side to the other. Even more preferably, the bridge 11055 may be configured with a cross-sectional shape which fits in the locking slots LS between the upstanding flanges, denoted USF. The Picatinny locking slot width is 0.206 in (5.23 mm). The spacing of slot centers is 0.394 in (10.01 mm) and the slot depth is 0.118 in (3.00 mm). Even more preferably, the bridge 11055 may be configured and dimensioned for close tolerance fit within a locking slot LS of the Picatinny rail R, or to the dimensions suitable for any other type or standard of weapon accessory mounting system. The attachment of the fore end grip 100 about a barrel cover BC by the assembly of the rods 1101, 1102 and rod guides 1105 tightly secures the fore end grip 100 about the barrel cover and closely proximate to the lateral edges of the Picatinny rail R, providing a large gripping surface and a large area heat sink. The migration of heat absorbed by the barrel cover BC is blocked by the fore end grip 100 from transfer to the user's hand.

Figure 13:
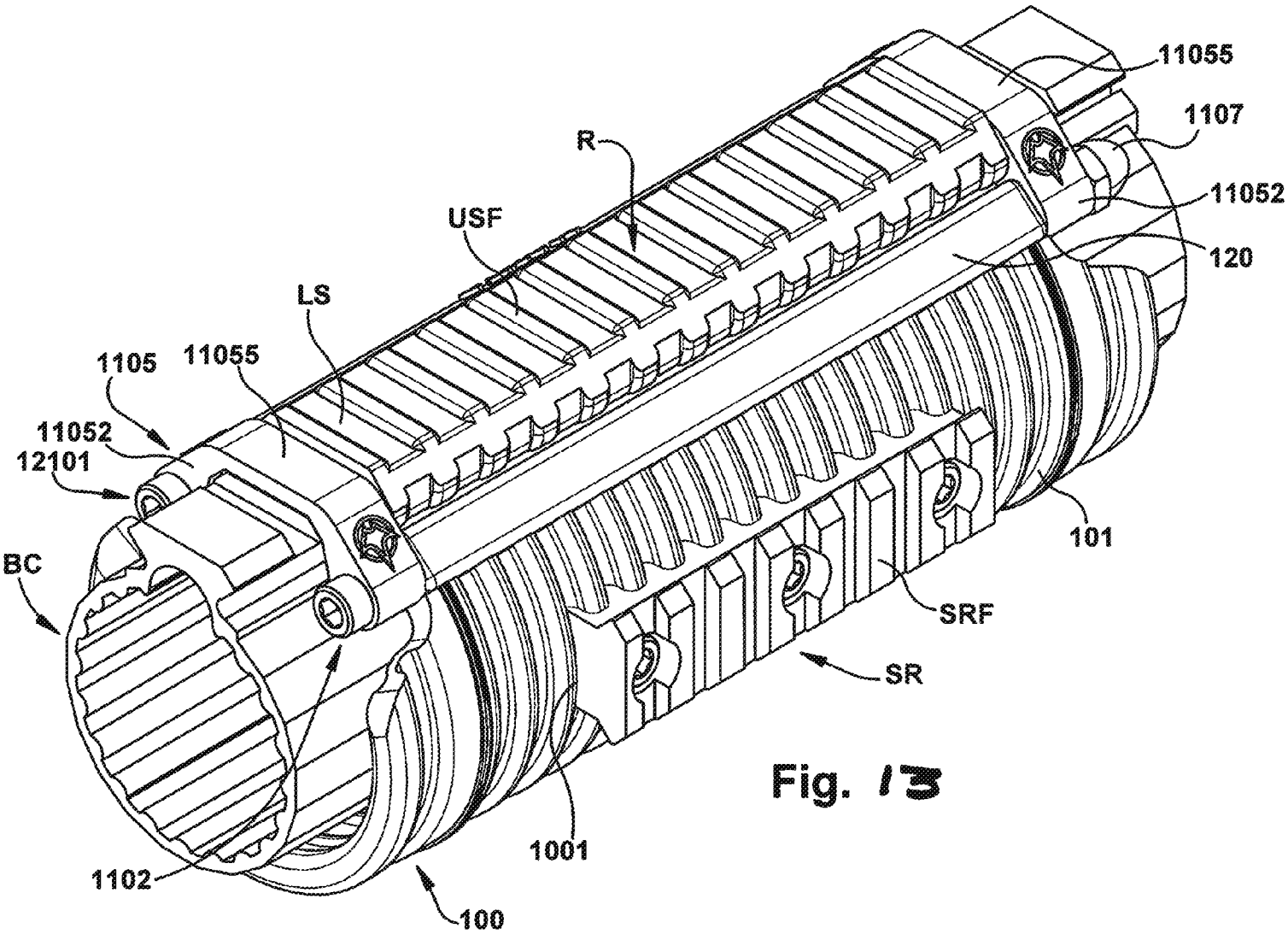
FIG. 13 is a perspective view of an alternate embodiment of a fore end grip of the present disclosure.
Figure 14:
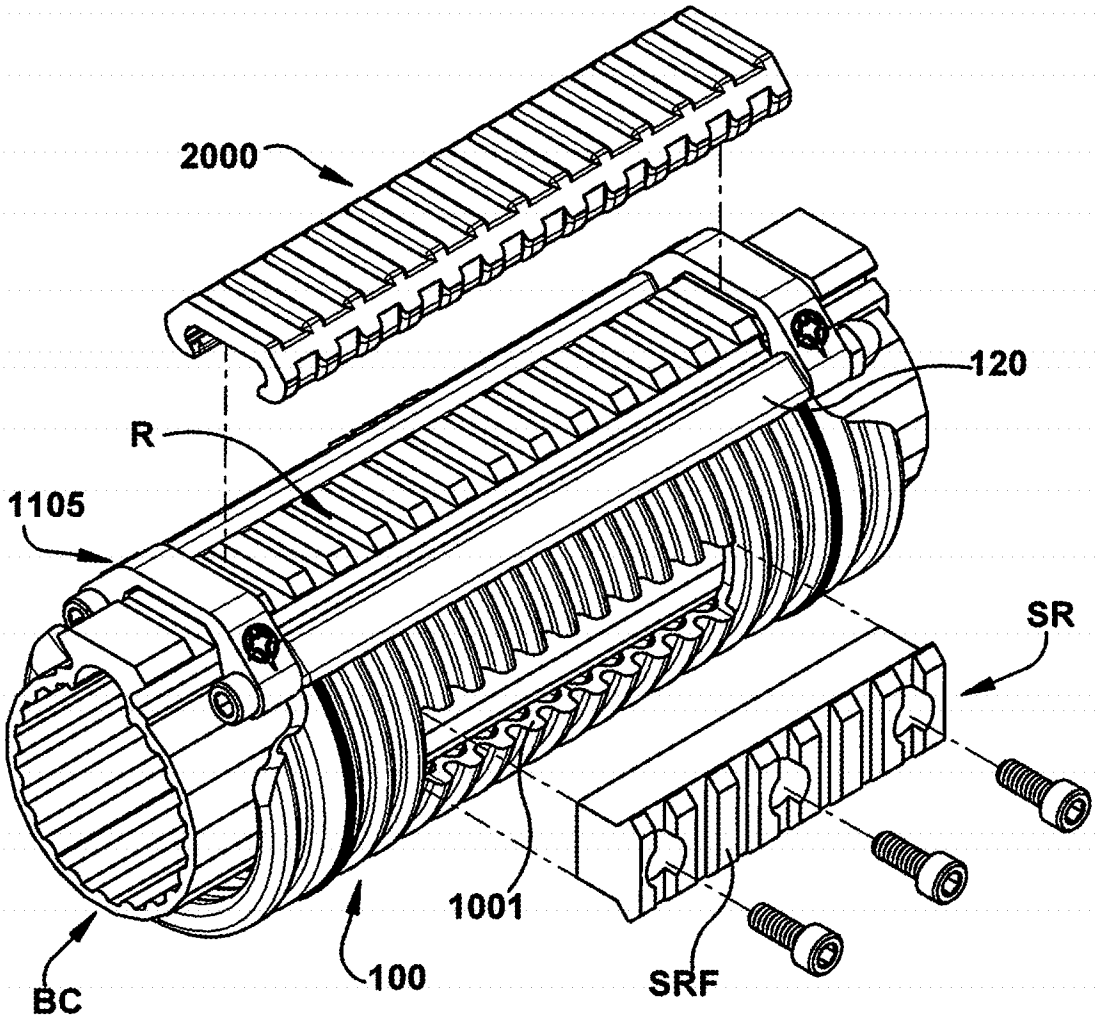
FIG. 14 is a perspective assembly view of the fore end grip of FIG. 13.

FIGS. 13 and 14 illustrate an alternate embodiment of a fore end grip assembly with substantially the same components as described with reference to FIGS. 11 and 12, but with an opening 1001 in the fore end grip 100 to accommodate and surround the projection of a side-mounted rail SR, the flanges SRF of which project through the fore end grip, for example laterally at the 9 O'clock or 3 o'clock position extending from the barrel cover BC for attachment of weapon accessories. The side rail SR may be attached to the barrel cover by key-hole or other fastener attachment as shown in FIG. 14. In this embodiment the fore end grip 100 still provides substantial coverage and protection of the user's hand but also allows for side-mounted weapon accessories such as lights or lasers.

Figure 15:
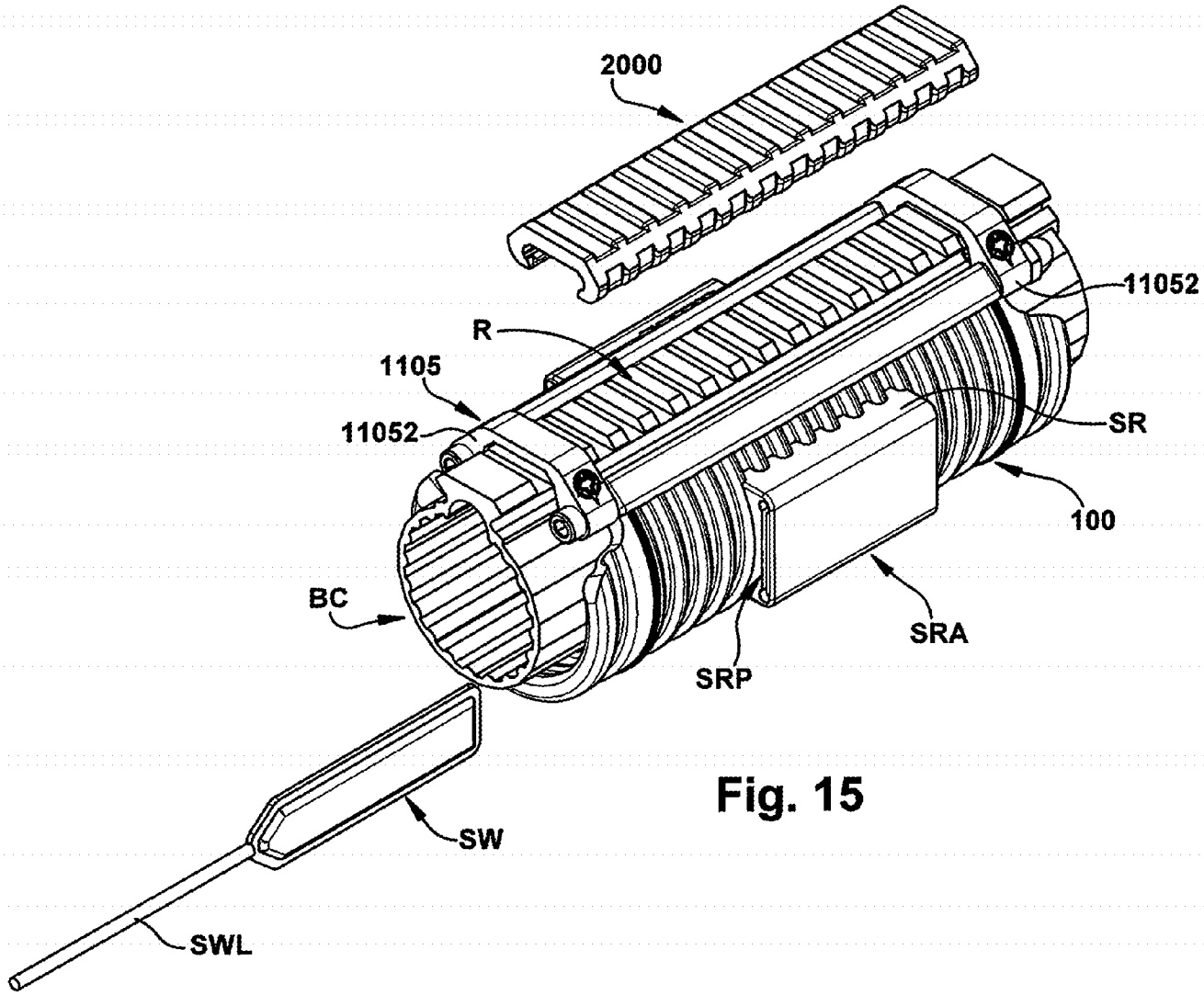
FIG. 15 is a perspective view of an alternate embodiment of a fore end grip assembly of the present disclosure.

FIG. 15 illustrates a fore end grip assembly similar to that of FIGS. 13 and 14, but wherein the side rail SR, which as described protrudes through the opening 1001 in the fore end grip 100, has a side rail attachment indicated as SRA. The side rail attachment SRA may be for example in the form of a generally planar piece or cover which attaches to the surfaces of the side rail flanges SRF shown in FIGS. 13 and 14, by fasteners, adhesive or other securement. In one form, the side rail attachment SRA may further include a compartment or pocket, indicated as SRP, which is dimensioned to receive an object such as switch SW, which may be for example a pressure type or momentary contact type switch device with a lead SWL attached thereto for electrical operation of a device such as a light or laser that is also attached to the gun or in electrical communication with another device or system of the gun or the gun user. Other non-limiting examples of devices may be installed in the side rail pocket SRP include batteries, antennae, sensors or any other weapon systems component.

Also illustrated in FIGS. 14 and 15 is a Picatinny rail guard indicated at 2000 which engages with the flanges of the rail R to cover and protect the rail, provide an additional gripping structure and surface, and block or reduce radiation of heat from the rail R, such as for example the Manta VLP type rail guard manufactured and sold by Advanced Innovation and Manufacturing, Inc. of New Philadelphia, Ohio, under the trade name MANTA®. Other types of rail covers can be used in combination with the fore end grips of the present disclosure.

FIGS. 16-19 illustrate additional alternate embodiments of firearm fore end grips. As shown in perspective in FIGS. 16 and 17, a fore end grip generally indicated at 400 with generally planar and opposed surfaces 401, 402 bounded by a perimeter 405. As shown in FIG. 16, an inside surface 401 configured for direct placement against a firearm fore end or barrel cover as described is outfitted with one or more securement or attachment devices or mechanisms, such as for example integrally molded structures 406, 407 and 408 in the forms of projections or buttons which can be engaged with corresponding openings in a barrel cover or other parts of a firearm. The structures may include but are not limited to suction cups 406, push-in carrots 407 or keymod male fasteners 408. Other attachment devices include hook-and-loop systems 411, magnets 413 or adhesive 414 on some or substantially all of surface 401. Integrally attached lacing 410 may also be provided. Also, devices may be incorporated into the body of the grip, such as a wire or spring or insert-molded metal piece indicated at 412 for attachment to a firearm fore end.

Figure 17:
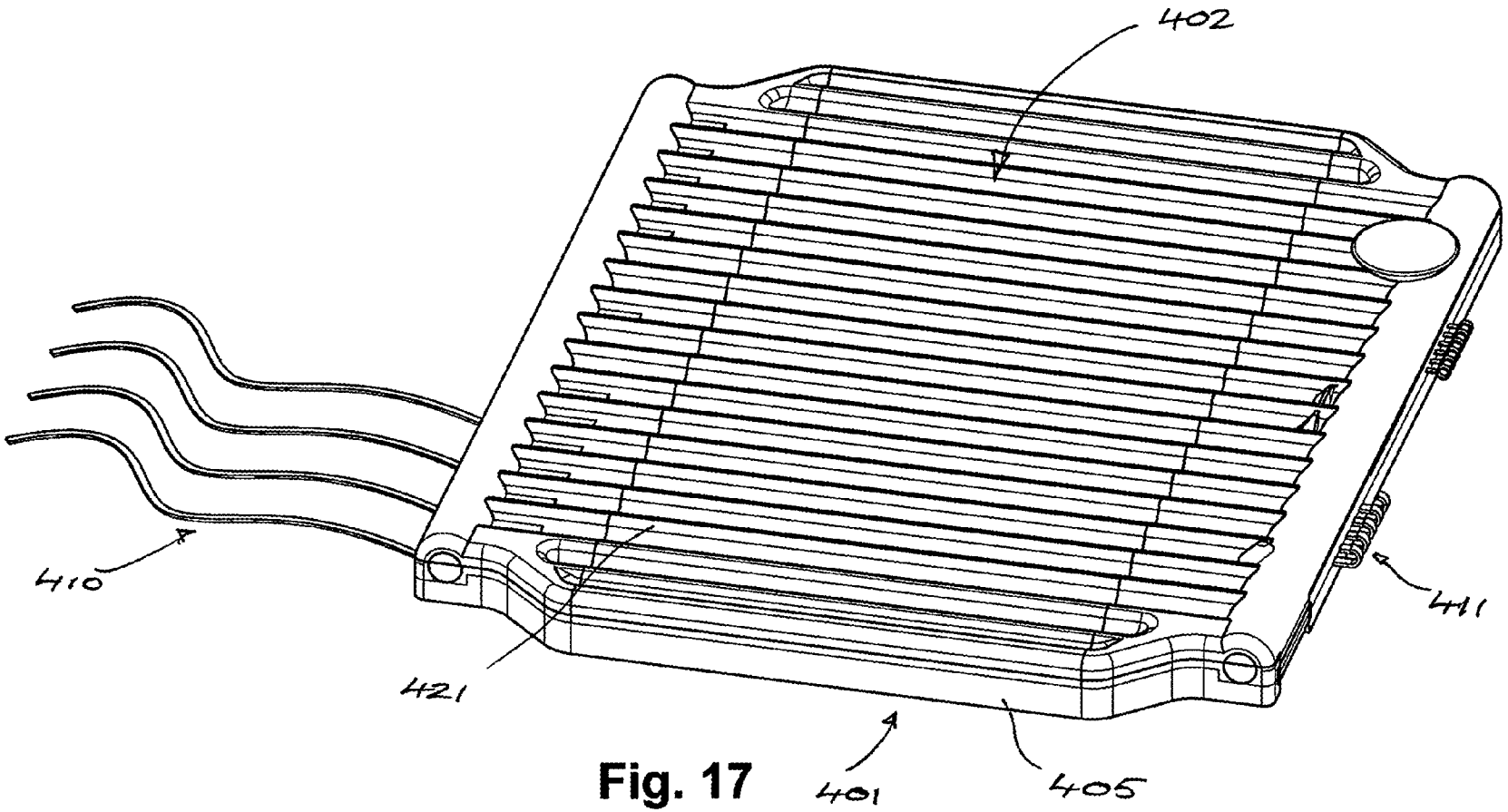
FIG. 17 is a perspective view of an alternate embodiment of a fore end grip of the present disclosure in an un-installed configuration.
Figure 18:
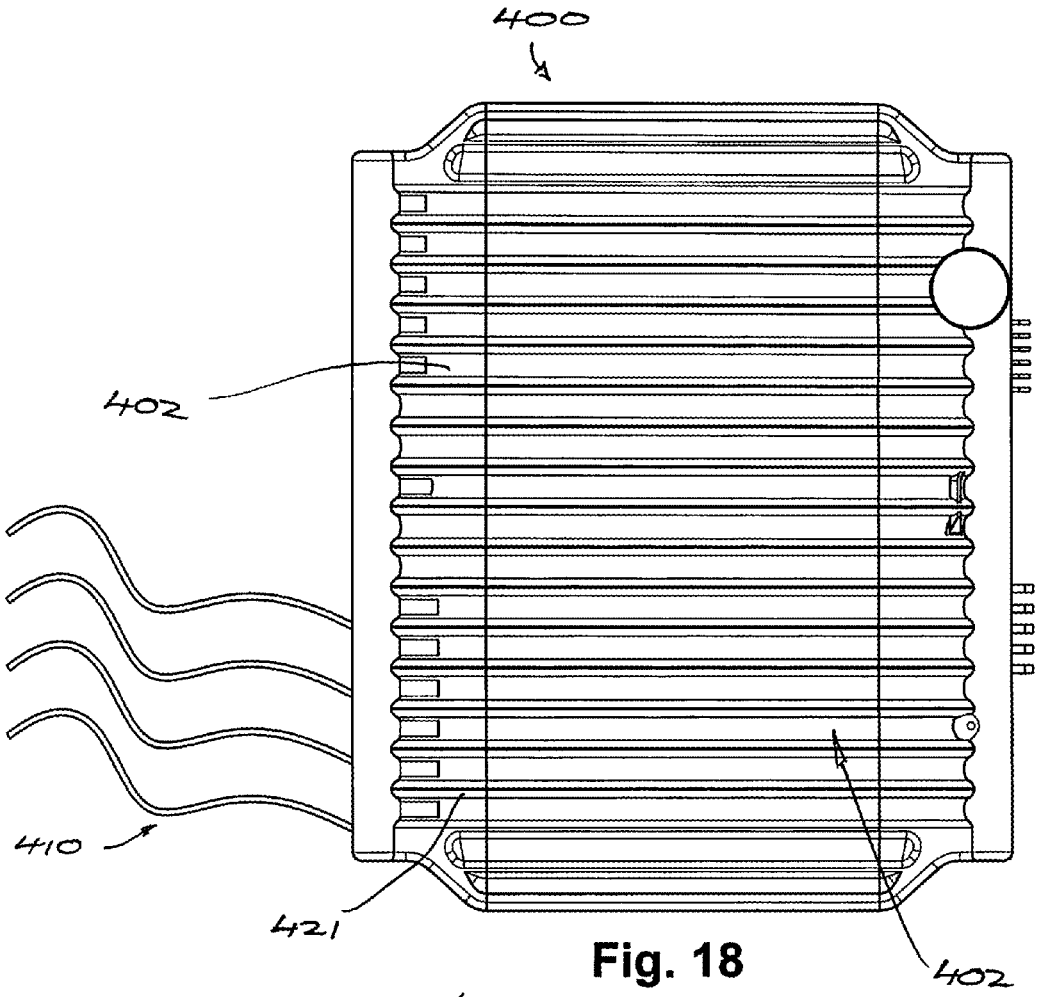
FIG. 18 is a perspective view of an alternate embodiment of a fore end grip of the present disclosure in an un-installed configuration.
Figure 19:
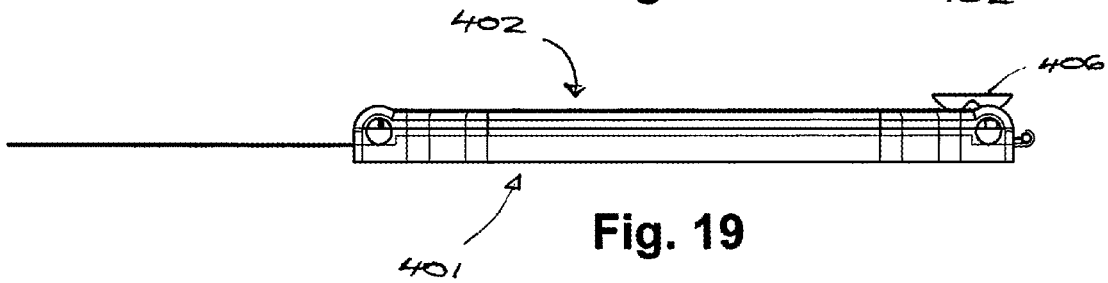
FIG. 19 is a side view of the fore end grip of FIG. 18.

As shown in FIGS. 17, 18 and 19, the opposing surface 402 of the grip 400 may be configured in any manner preferably in configurations which allow for secure handling and holding and heat insulation and dissipation. Such configurations preferably include one or more ridges or ribs 421 or other projections or pattern of projections which function to provide a positive gripping and handling surface and also improve heat dissipation by the additional surface area provided by each protrusion or projection.

Each of the different embodiments of the fore end grips 100 of the disclosure are preferably molded of a polymeric material and preferably an elastic polymer or "elastomer" and thermoplastic elastomers which exhibit visco-elasticity in durometers in the approximate hardness ranges of, for example 5 Shore A to 90 Shore A, 40 Shore A or lower and up to 80 Shore A, and a more preferred range of 40 Shore A to 70 Shore A, and an even more preferred range of 50 Shore A to 70 Shore A, and an even more preferred range of 35 Shore A to 60 Shore A. such materials include, for example, one or more of the following: synthetic rubber, natural rubber, neoprene, butyl rubber, silicone, urethane, viscoelastic urethane, nylon, PVC, polyethylene, polystyrene, polypropylene, PVB, PVDF or Nanbrol®, a nano-particle reinforced nitrile butadiene rubber (NBR), and thermoplastic polymer alloys with SBR, EPDM or urethanes as base polymers and blended to optimize dynamic properties, dimensional stability and elasticity, thermal resistance and fatigue performance. Additives which can be used with these materials in the manufacture of the described gun rail attachments include glass beads, Expandacel™, Kevlar™, Mylar™, fiberglass, cotton or other woven or non-woven materials in internal layers with the gun rail attachment bodies. Additives or coatings (such as, for example, Nomex™ or Nitrile™) can be selectively incorporated into the gun rail attachment body material or design for improved heat resistance, durability, strength, tackiness or surface friction, or any other desired properties.

The use of thermoplastic polymers in these hardness ranges for the fore end grips 100, gun rail attachments and other firearm components which attach to or fit with various firearms provides numerous advantages, such as a far superior gripping structure and feel than the relatively much harder rail cover attachments of the prior art, heat guarding for the operator, and shock absorption and damage protection for the weapon. The use of visco-elastic materials in the disclosed hardness ratings provides numerous advantages over the much harder plastic rail covers of the prior art. The fore end grips 100 provide a gripping structure and surface which can be squeezed as a relatively soft grip over the steel gun rail, dramatically improving the secure handling of a gun by the barrel, shock and recoil absorption, vibration dampening—including automatic or semi-automatic fire recoil and recoil vibration, resistance to moisture and grease, a high friction gripping surface even when wet, temperature insulation, reduction of infra-red signature and mirage effect, sound insulation and noise reduction and cushioning, an improved mounting surface for the gun barrel, protection against operator burns, damage protection for the gun, and other advantages and benefits as further described herein. A preferred material compound resists extreme heat and cold temperature fluctuations and will maintain its flexibility and tactile feel in a wide range of environments.

The invention claimed is:

1. A grip assembly for a rifle, the grip assembly comprising:

a generally planar fore end grip configured to fit around a fore end of a rifle, the fore end grip having a first longitudinal side and a second longitudinal side, the first and second longitudinal sides extending between a front edge and a rear edge of the fore end grip;

a first attachment structure integrally formed proximate to the first longitudinal side of the fore end grip;

a second attachment structure integrally formed proximate to the second longitudinal side;

a first grip attachment device configured to extend from the first attachment structure proximate to the front edge of the fore end grip to the second attachment structure proximate to the front edge of the fore end grip;

a second grip attachment device configured to extend from the first attachment structure proximate to the rear edge to the second attachment structure proximate to the rear edge;

whereby the fore end grip extends around and is secured to the fore end of a rifle by the first and second fore end grip attachment devices; and wherein the first grip attachment device is configured to fit at least partially between flanges of a Picatinny rail.

2. The grip assembly of claim 1 wherein the second grip attachment device is configured to fit at least partially between flanges of a Picatinny rail.

3. The grip assembly of claim 1 wherein the first attachment structure includes an opening proximate to the first longitudinal side of the fore end grip.

4. The grip assembly of claim 1 wherein the second attachment structure includes an opening proximate to the second longitudinal side of the fore end grip.

5. A grip assembly for a rifle, the grip assembly comprising:

a generally planar fore end grip configured to fit around a fore end of a rifle, the fore end grip having a first longitudinal side and a second longitudinal side, the first and second longitudinal sides extending between a front edge and a rear edge of the fore end grip;

a first attachment structure integrally formed proximate to the first longitudinal side of the fore end grip;

a second attachment structure integrally formed proximate to the second longitudinal side;

a first grip attachment device configured to extend from the first attachment structure proximate to the front edge of the fore end grip to the second attachment structure proximate to the front edge of the fore end grip;

a second grip attachment device configured to extend from the first attachment structure proximate to the rear edge to the second attachment structure proximate to the rear edge;

whereby the fore end grip extends around and is secured to the fore end of a rifle by the first and second fore end grip attachment devices; and a first grip attachment member which extends into the first attachment structure of the fore end grip.

6. The grip assembly of claim 5 further comprising a second grip attachment member which extends into the second attachment structure of the fore end grip.

7. The grip assembly of claim 5 wherein the first grip attachment member extends into the first attachment structure of the fore end grip and extends from the front edge to the rear edge of the fore end grip.

8. The grip assembly of claim 6 wherein the second grip attachment member extends into the second attachment structure of the fore end grip and extends from the front edge to the rear edge of the fore end grip.

9. The grip assembly of claim 5 wherein the first grip attachment device is connected to the first grip attachment member.

10. The grip assembly of claim 6 wherein the second grip attachment device is connected to the second grip attachment member.

11. A fore end cover for a firearm, comprising:

a flexible member having a forward end and a rearward end spaced from the forward end;

a first longitudinal edge which extends from the forward end to the rearward end;

a second longitudinal edge spaced from the first longitudinal edge and which extends from the forward end to the rearward end;

a first attachment device connected to the flexible member and which extends from the first longitudinal edge to the second longitudinal edge of the flexible member when the first longitudinal edge of the flexible member is generally aligned with the second longitudinal edge of the flexible member, a second attachment device connected to the flexible member and which extends from the first longitudinal edge to the second longitudinal edge of the flexible member when the first longitudinal edge of the flexible member is generally aligned with the second longitudinal edge of the flexible member; and wherein the first attachment device and the second attachment device are each configured to fit partially between flanges of a Picatinny rail.

12. The fore end cover of claim 11 wherein the first attachment device is connected to the flexible member proximate to the first longitudinal edge of the flexible member and proximate to the forward end of the flexible member.

13. The fore end cover of claim 11 wherein the second attachment device is connected to the flexible member proximate to the first longitudinal edge of the flexible member and proximate to the rearward end of the flexible member.

14. The fore end cover of claim 11 wherein the flexible member has an attachment structure proximate to the first longitudinal edge configured for engagement with the first attachment device.

15. The fore end cover of claim 11 wherein the flexible member has an attachment structure proximate to the second longitudinal edge configured for engagement with the second attachment device.

16. The fore end cover of claim 14 wherein the attachment structure proximate to the first longitudinal edge of the flexible member is in the general form of a bore.

17. The fore end cover of claim 15 wherein the attachment structure proximate to the second longitudinal edge of the flexible member is in the general form of a bore.

18. A fore end cover for a firearm, comprising:

a flexible member having a forward end and a rearward end spaced from the forward end;

a first longitudinal edge which extends from the forward end to the rearward end;

a second longitudinal edge spaced from the first longitudinal edge and which extends from the forward end to the rearward end;

a first attachment device connected to the flexible member and which extends from the first longitudinal edge to the second longitudinal edge of the flexible member when the first longitudinal edge of the flexible member is generally aligned with the second longitudinal edge of the flexible member, a second attachment device connected to the flexible member and which extends from the first longitudinal edge to the second longitudinal edge of the flexible member when the first longitudinal edge of the flexible member is generally aligned with the second longitudinal edge of the flexible member;

wherein the flexible member has an attachment structure proximate to the first longitudinal edge configured for engagement with the first attachment device; and a rod which extends from the first attachment device into the attachment structure proximate to the first longitudinal edge of the flexible member.

19. A fore end cover for a firearm, comprising:

a flexible member having a forward end and a rearward end spaced from the forward end;

a first longitudinal edge which extends from the forward end to the rearward end;

a second longitudinal edge spaced from the first longitudinal edge and which extends from the forward end to the rearward end;

a first attachment device connected to the flexible member and which extends from the first longitudinal edge to the second longitudinal edge of the flexible member when the first longitudinal edge of the flexible member is generally aligned with the second longitudinal edge of the flexible member, a second attachment device connected to the flexible member and which extends from the first longitudinal edge to the second longitudinal edge of the flexible member when the first longitudinal edge of the flexible member is generally aligned with the second longitudinal edge of the flexible member;

wherein the flexible member has an attachment structure proximate to the second longitudinal edge configured for engagement with the second attachment device; and a rod which extends from the second attachment device into the attachment structure proximate to the second longitudinal edge of the flexible member.

20. The fore end cover of claim 18 wherein the rod which extends from the first attachment device into the attachment structure proximate to the first longitudinal edge of the flexible member is also connected to the second attachment device.

21. The fore end cover of claim 19 wherein the rod which extends from the first attachment device into the attachment structure proximate to the second longitudinal edge of the flexible member is also connected to the second attachment device.

22. The fore end cover of claim 11 wherein the flexible member with the first longitudinal edge and the second longitudinal edge connected to the first attachment device and the second attachment device has a circumference which fits around the fore end of a firearm.

* * * * *